US008047527B2

(12) United States Patent
Adachi et al.

(10) Patent No.: US 8,047,527 B2
(45) Date of Patent: Nov. 1, 2011

(54) SHEET CONTAINING APPARATUS AND IMAGE FORMING SYSTEM

(75) Inventors: Yuichi Adachi, Ebina (JP); Yoshiaki Watanabe, Ebina (JP); Mitsuhiro Nakamura, Ebina (JP); Yoshiyuki Kitazawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 271 days.

(21) Appl. No.: 12/421,899

(22) Filed: Apr. 10, 2009

(65) Prior Publication Data

US 2009/0256303 A1 Oct. 15, 2009

(30) Foreign Application Priority Data

Apr. 14, 2008 (JP) ..... 2008-105005
Feb. 25, 2009 (JP) ..... 2009-042826

(51) Int. Cl.
*B65H 3/44* (2006.01)
*B65H 5/26* (2006.01)
*B65H 1/00* (2006.01)
*B65H 1/30* (2006.01)

(52) U.S. Cl. ..... 271/9.01; 271/9.11; 271/162; 271/157

(58) Field of Classification Search ..... 271/9.01, 271/9.11, 162, 164, 157
See application file for complete search history.

(56) References Cited

U.S. PATENT DOCUMENTS

2007/0052163 A1 3/2007 Sasaki et al.

FOREIGN PATENT DOCUMENTS

| | | |
|---|---|---|
| JP | 07-330214 | 12/1995 |
| JP | 11-157686 | 6/1999 |
| JP | 2001-048360 | 2/2001 |
| JP | 2004-196539 | 7/2004 |
| JP | 2007-099470 | 4/2007 |
| JP | 2008-030903 | 2/2008 |

OTHER PUBLICATIONS

Konica Service Manual, Models 7145, 7222/7228/7235, Apr. 2004, CSM-7145, 7222/7228/7235, Konica Minolta Business Solutions U.S.C., Inc., pp. 1-447.

*Primary Examiner* — David H Bollinger
(74) *Attorney, Agent, or Firm* — Morgan, Lewis & Bockius LLP

(57) ABSTRACT

The sheet containing apparatus is provided with: an apparatus main body; a drawer that is capable of being pulled out from the apparatus main body; a sheet container that is movable relative to the drawer and that contains a sheet; a feeder that feeds a sheet contained in the sheet container; and a moving unit that moves the sheet container in a direction intersecting with a feed direction in which the feeder feeds a sheet.

10 Claims, 9 Drawing Sheets

SHEET CONTAINING APPARATUS AND IMAGE FORMING SYSTEM

CROSS REFERENCE TO RELATED APPLICATIONS

This application is based on and claims priority under 35 USC §119 from Japanese Patent Applications No. 2009-42826 filed Feb. 25, 2009 and No. 2008-105005 filed Apr. 14, 2008.

BACKGROUND

1. Technical Field

The present invention relates to a sheet containing apparatus and an image forming system.

2. Related Art

There has been known techniques for paper sheet containing form using a side-based approach and for paper sheet transporting form using a center-based approach.

SUMMARY

According to an aspect of the present invention, there is provided a sheet containing apparatus including: an apparatus main body; a drawer that is capable of being pulled out from the apparatus main body; a sheet container that is movable relative to the drawer and that contains a sheet; a feeder that feeds a sheet contained in the sheet container; and a moving unit that moves the sheet container in a direction intersecting with a feed direction in which the feeder feeds a sheet.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described in detail below with reference to the accompanying drawings.

Figure 1:
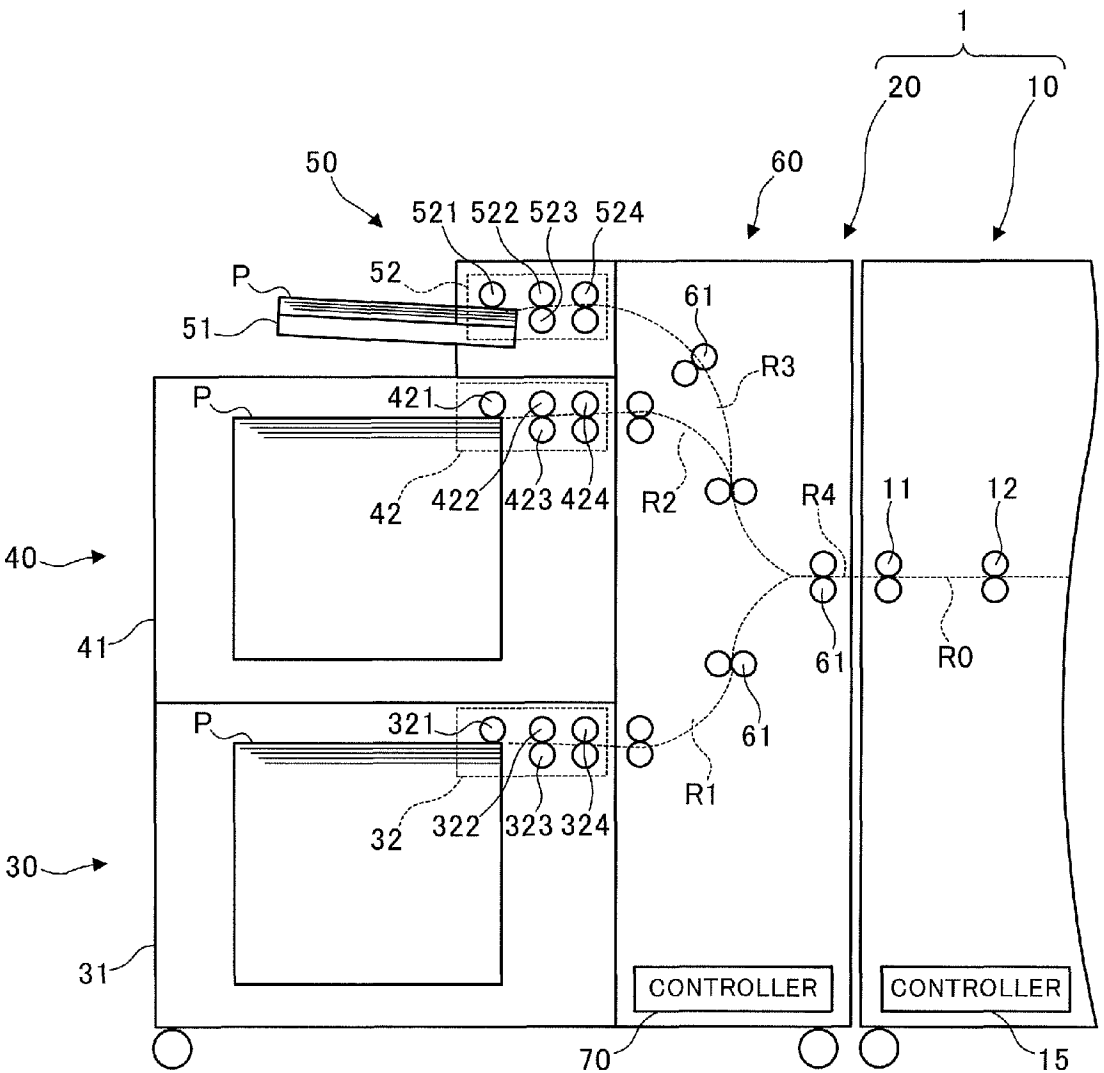
FIG. 1 is a schematic view showing a configuration example of an image forming apparatus to which the present invention is applied.

FIG. 1 is a schematic view showing a configuration example of an image forming apparatus to which the present invention is applied. An image forming apparatus 1 shown in FIG. 1 is configured of an image forming apparatus main body 10, and a supplying unit 20 that supplies a paper sheet, serving as an example of a sheet, to the image forming apparatus main body 10.

Here, the image forming apparatus main body 10 includes a paper sheet transport route R0 for transport of the paper sheet to be subjected to image formation, transport rolls 11 and 12 that serve as a transporting unit that transports the paper sheet along the paper sheet transport route R0, and an image forming part (not shown in the figure) that forms an image on the paper sheet transported thereto by the transport rolls 11 and 12 and the like. Incidentally, the image forming part may form the image on the paper sheet, by use of electrophotography, for example. Further, the image forming apparatus main body 10 includes a controller 15 that performs control on the above-mentioned transport rolls 11 and 12 as well as the image forming part and also performs control over the image forming apparatus 1.

On the other hand, the supplying unit 20 includes a first paper sheet feeder 30 (as an example of a sheet containing apparatus) that contains a paper sheet P therein and also feeds the paper sheet P to the image forming apparatus main body 10, a second paper sheet feeder 40 that contains a paper sheet P therein and also feeds the paper sheet P to the image forming apparatus main body 10 and a third paper sheet feeder 50 that feeds a manually fed-in paper sheet P to the image forming apparatus main body 10. Further, the supplying unit 20 includes a transferring device 60 that transfers the paper sheet P fed from any one of the first paper sheet feeder 30, the second paper sheet feeder 40 and the third paper sheet feeder 50 to the image forming apparatus main body 10. Further, the supplying unit 20 includes a controller 70 that controls the first paper sheet feeder 30, the second paper sheet feeder 40, the third paper sheet feeder 50 and the transferring device 60.

The first paper sheet feeder 30 includes a feeder main body 31, and a paper sheet feeding portion 32 that sequentially feeds the paper sheets P contained in the feeder main body 31.

In more detail, the paper sheet feeding portion 32 includes a pickup roll 321, a feed roll 322, a retard roll 323 and transport rolls 324. The pickup roll 321 is one example of a feeder that feeds paper sheets P by coming into contact with the topmost paper sheet P of the stacked paper sheets P. The feed roll 322 and the retard roll 323 feed the paper sheets P fed by the pickup roll 321 by separating the paper sheets P one by one. The transport rolls 324 transport the paper sheet P fed from the feed roll 322 and the retard roll 323 to the transferring device 60.

Incidentally, the second paper sheet feeder 40, which is configured similarly to the first paper sheet feeder 30, includes a feeder main body 41, and a paper sheet feeding portion 42 that sequentially feeds the paper sheets P contained in the feeder main body 41. Further, the paper sheet feeding portion 42 includes a pickup roll 421 that feeds the paper sheets P while coming into contact with the topmost paper sheet P of the stacked paper sheets P, a feed roll 422 and a retard roll 423 that feed the paper sheets P fed by the pickup roll 421 by separating the paper sheets P one by one, and transport rolls 424 that transport the paper sheet P fed from the feed roll 422 and the retard roll 423 to the transferring device 60.

The third paper sheet feeder 50 includes a paper sheet stacking portion 51 on which the paper sheet P is stacked, and a paper sheet feeding portion 52 that sequentially feeds the paper sheets P stacked on the paper sheet stacking portion 51. The paper sheet feeding portion 52 includes a pickup roll 521 that feeds the paper sheets P while coming into contact with the topmost paper sheet P of the paper sheets P stacked on the paper sheet stacking portion 51, a feed roll 522 and a retard roll 523 that feed the paper sheets P fed by the pickup roll 521 by separating the paper sheets P one by one, and transport rolls 524 that transport the paper sheet P fed from the feed roll 522 and the retard roll 523 to the transferring device 60.

On the other hand, the transferring device 60 includes a first transport route R1 for transport of the paper sheet P from the first paper sheet feeder 30 toward the image forming apparatus main body 10, a second transport route R2 for transport of the paper sheet P from the second paper sheet feeder 40 toward the image forming apparatus main body 10, and a third transport route R3 for transport of the paper sheet P from the third paper sheet feeder 50 toward the image forming apparatus main body 10. Further, the transferring device 60 includes a fourth transport route R4 where the paper sheet P transported via any one of the first to third transport routes R1 to R3 is transported to the paper sheet transport route R0 in the image forming apparatus main body 10. Furthermore, the transferring device 60 includes plural transport rolls 61 on each of the first to fourth transport routes R1 to R4.

For example, in a case of image formation on the paper sheet P contained in the first paper sheet feeder 30, the paper sheets P are first taken out by the pickup roll 321 of the paper sheet feeding portion 32. Then, the paper sheets P taken out are separated one by one by the feed roll 322 and the retard roll 323. Then, the separated paper sheet P is transported by the transport rolls 324 to the first transport route R1 in the transferring device 60. Subsequently, the paper sheet P is transported by the transport rolls 61 along the first transport route R1 and the fourth transport route R4, and is transported to the paper sheet transport route R0 of the image forming apparatus main body 10.

Then, the paper sheet P is transported by the transport rolls 11 and 12 and the like along the paper sheet transport route R0 and is further transported to the image forming part. Then, the image forming part forms an image on the paper sheet P. After that, the paper sheet P having the image formed thereon is stacked on an output paper sheet stacking portion (not shown in the figure) provided outside of the image forming apparatus main body 10. Incidentally, in the image forming part, a toner image is formed on an image carrier such as a photoconductive drum or an intermediate transfer body through processes of charge, exposure, and development. Then, the toner image is transferred to the paper sheet P by a transfer device and is fixed to the paper sheet P by a fixing device.

On the other hand, for example, in a case of image formation on the paper sheet P stacked on the paper sheet stacking portion 51 of the third paper sheet feeder 50, paper sheets P are first taken out by the pickup roll 521 of the paper sheet feeding portion 52. Then, the paper sheets taken out are separated one by one by the feed roll 522 and the retard roll 523. Then, the separated paper sheet P is transported by the transport rolls 524 to the third transport route R3 in the transferring device 60. Subsequently, the paper sheet P is transported by the transport rolls 61 along the third transport route R3 and the fourth transport route R4, and is transported to the paper sheet transport route R0 of the image forming apparatus main body 10. Then, the paper sheet P is subjected to the image formation by the image forming part in the image forming apparatus main body 10, similarly to the above description.

The first paper sheet feeder 30 will be described in further detail.

Figure 2:
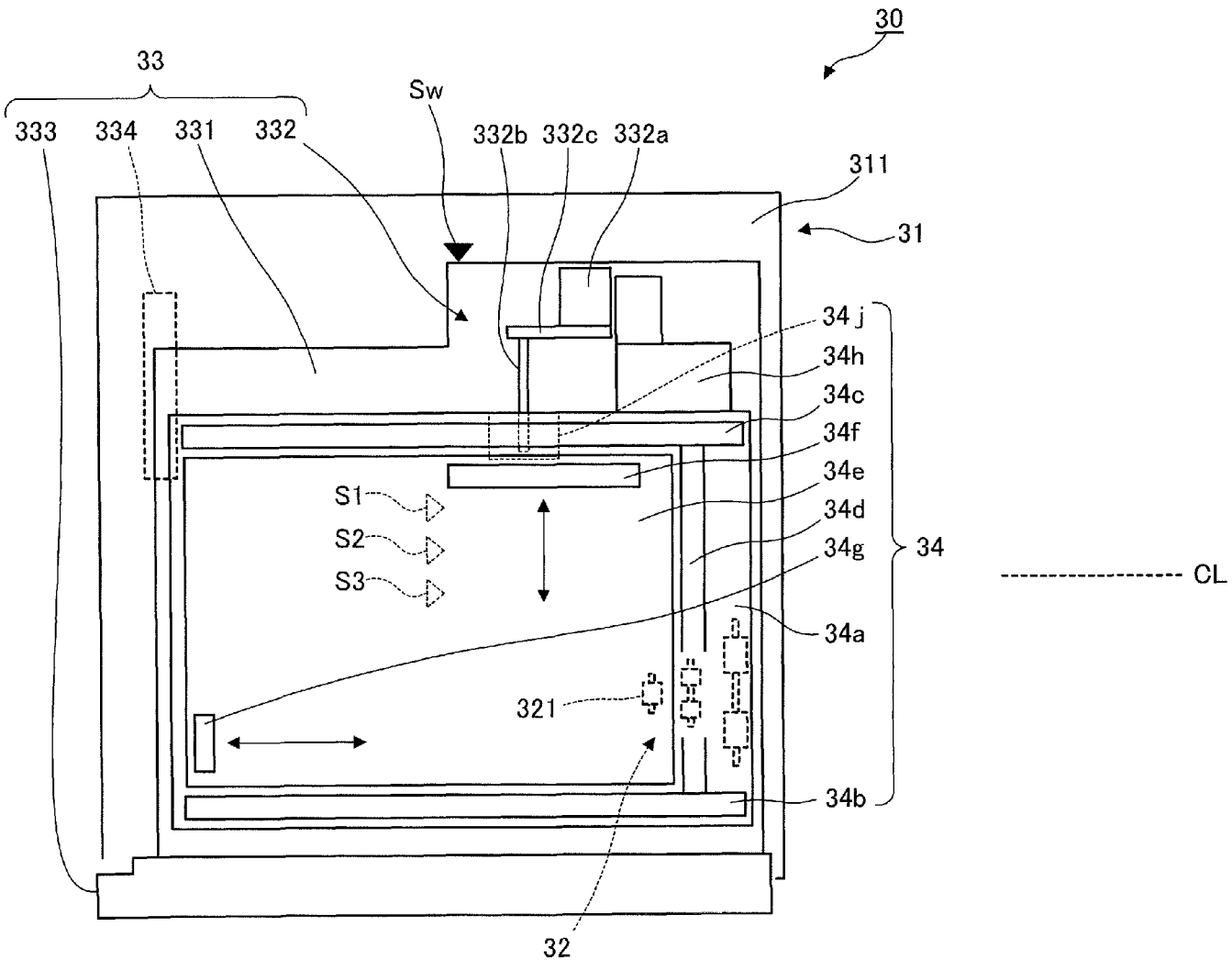
FIG. 2 is a top view of the first paper sheet feeder.

FIG. 2 is a top view of the first paper sheet feeder 30.

As shown in FIG. 2, the first paper sheet feeder 30 includes a drawer unit 33 that serves as an example of a drawer mounted in a position set in advance of the feeder main body 31 and that is provided so as to be capable of being pulled out from the front side of the feeder main body 31, and a containing unit 34 (serving as an example of a sheet container) that is provided above the drawer unit 33 and that contains paper sheets. Note that, the containing unit 34 according to the present exemplary embodiment is provided slidably (or movably) relative to the drawer unit 33, and independently of the drawer unit 33. In more detail, the containing unit 34 is provided slidably in a direction orthogonal to a paper sheet transport direction. More specifically, the containing unit 34 is provided slidably in a direction intersecting with a feed direction in which the pickup roll 321 feeds the paper sheet P. Further, the first paper sheet feeder 30 includes a detecting switch Sw that detects the mounting of the drawer unit 33 in the feeder main body 31.

The drawer unit 33 includes a base plate 331 that is provided below the containing unit 34 and above a base plate 311 forming a lower portion of the feeder main body 31, and a driver 332 that is mounted on a top surface of the base plate 331 and that slides the containing unit 34. The driver 332 according to the present exemplary embodiment functions as one form of a moving unit that moves the containing unit 34. Further, the drawer unit 33 includes a cover 333 that is provided on the front side of the base plate 331 and that is grasped by a user when the drawer unit 33 is pulled out or other operation is made, and a detecting unit 334 that detects the position of the containing unit 34 relative to the drawer unit 33.

Here, the driver 332 according to the present exemplary embodiment includes a motor 332*a* serving as an example of a driving source, a shaft 332*b* that is rotatably provided and that has a threaded portion on an outer circumferential surface, and a gear 332*c* that transmits a driving force from the motor 332*a* to the shaft 332*b*. Incidentally, in the present exemplary embodiment, a stepping motor is used as the motor 332*a*. Also, in the present exemplary embodiment, the shaft 332*b* is arranged in the direction orthogonal to the paper sheet transport direction.

The containing unit 34 includes a base plate 34*a* that is arranged above the drawer unit 33 and constitutes a part of a may body of the containing unit 34, a first side plate 34*b* that extends upwardly, that is arranged fixedly on the base plate 34*a* and that is also arranged perpendicularly to the base plate 34*a*, and, likewise, a second side plate 34*c* that extends upwardly, and that is arranged perpendicularly to the base plate 34*a*. Also, the containing unit 34 includes a third side plate 34*d* that extends upwardly, and that is arranged perpendicularly to the base plate 34*a*. Here, the first side plate 34*b* and the second side plate 34*c* are arranged so as to face each other and also arranged in the paper sheet transport direction. Also, the first side plate 34*b* is arranged on the front side, and the second side plate 34*c* is arranged on the rear side. Further, the third side plate 34*d* is arranged on the downstream side of the paper sheet transport direction, in the base plate 34*a*, and is also arranged along the direction orthogonal to the paper sheet transport direction. Incidentally, the third side plate 34*d* supports the paper sheet feeding portion 32. Thus, the sliding of the containing unit 34 leads to the sliding of the paper sheet feeding portion 32 together with the containing unit 34.

The containing unit 34 further includes a bottom plate 34*e* that is provided movably in an up and down direction and that functions as a stacking unit on which paper sheet is to be stacked, a side guide 34*f*, an end guide 34*g*, and a driver 34*h* that upwardly moves the bottom plate 34*e*. Also, the containing unit 34 includes a driven unit 34*j* driven by the above-mentioned driver 332, and detecting sensors S1 to S3 that detect the position of the side guide 34*f*.

The side guide 34*f* is arranged on a position facing the first side plate 34*b*. Also, the side guide 34*f* is arranged on the rear side behind the first side plate 34*b* and is also arranged so as to move forward and backward with respect to the first side plate 34*b*. More specifically, the side guide 34*f* is provided slidably in the direction orthogonal to the paper sheet transport direction. Then, the side guide 34*f* comes into contact with a side edge, in the width direction, of the paper sheet stacked on the bottom plate 34*e* thereby to align the paper sheet, together with the first side plate 34*b*.

The end guide 34*g* is arranged on a position facing the third side plate 34*d*, and is also arranged so as to move forward and backward with respect to the third side plate 34*d*. More specifically, the end guide 34*g* is provided slidably in the paper sheet transport direction. Then, the end guide 34*g* comes into contact with the rear end of the paper sheet stacked on the bottom plate 34*e* thereby to align the paper sheet, together with the third side plate 34*d*.

The driver 34*h* includes a motor and plural gears rotatably driven by the motor, and rotatably drives a shaft (not shown in the figure). Then, when the shaft is rotatably driven, a wire (not shown in the figure) is wound up by the shaft, so that the bottom plate 34*e* is moved upward by the wire. Thereby, the topmost paper sheet of the paper sheets stacked on the bottom plate 34*e* is arranged so as to be in contact with the pickup roll 321 of the paper sheet feeding portion 32.

The driven unit 34*j* is attached to the base plate 34*a*. Also, the driven unit 34*j* includes an insert hole (not shown in the figure) into which the above-mentioned shaft 332*b* is inserted. Further, the insert hole has, on its inner circumferential surface, an internal thread portion (not shown in the figure) that engages with the above-mentioned threaded portion formed on the outer circumferential surface of the shaft 332*b*. Thus, when the shaft 332*b* is rotatably driven, the driven unit 34*j* slides in the direction where the shaft 332*b* is arranged. With this sliding, the containing unit 34 likewise slides in the direction where the shaft 332*b* is arranged, that is, in the direction orthogonal to the paper sheet transport direction.

The detecting sensors S1 to S3 are arranged under the bottom plate 34*e* and also arranged in the direction in which the side guide 34*f* moves forward and backward, and detect the position of the side guide 34*f*. Specifically, each of the detecting sensors S1 to S3 changes its on-off state depending on the position of the side guide 34*f*. For example, if a paper sheet having the largest size is contained, all the detecting sensors S1 to S3 are turned on. Also, for example, if a paper sheet having the smallest size is contained, all the detecting sensors S1 to S3 are turned off. Also, for example, if a paper sheet having the size smaller than the largest size and also larger than the smallest size is contained, the detecting sensor S3, for example, is turned on, while the other sensors S1 and S2 are turned off.

Figure 3A:
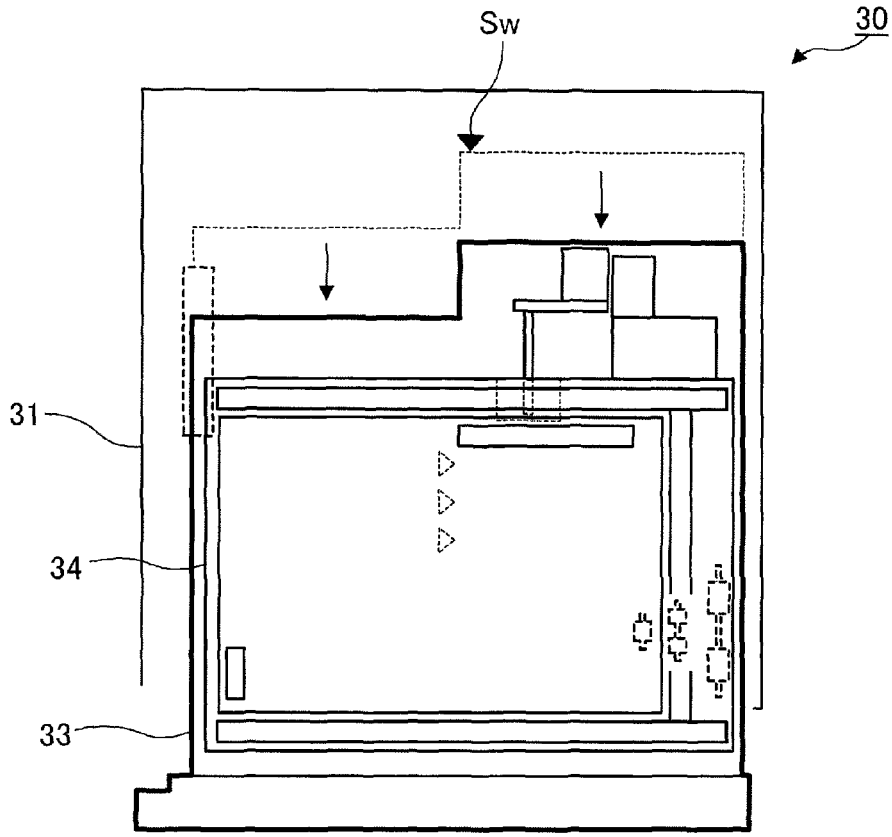
FIGS. 3A and 3B are views for explaining operation of the drawer unit and the containing unit.
Figure 3B:
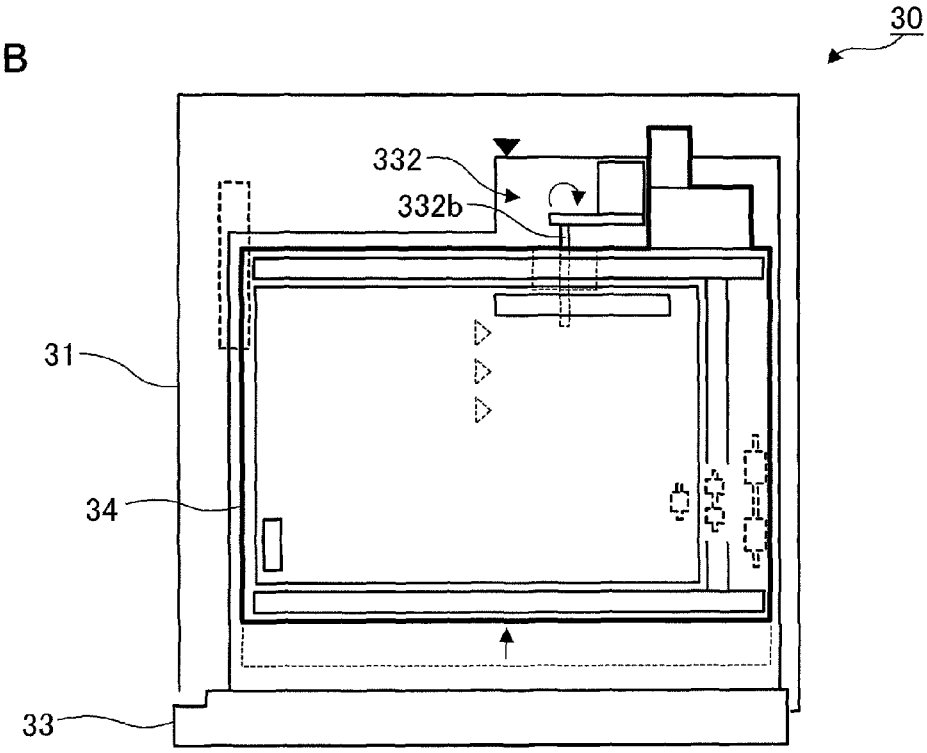

FIGS. 3A and 3B are views for explaining operation of the drawer unit 33 and the containing unit 34. As mentioned above, the drawer unit 33 is provided so as to be capable of being pulled out from the front side. For example, if no paper sheet is present in the containing unit 34, the user pulls out the drawer unit 33 as shown in FIG. 3A. In this case, the containing unit 34 is pulled out together with the drawer unit 33. This permits paper sheet supply to the containing unit 34. After that, the drawer unit 33 is pushed back by the user and thereby put back to a position set in advance in the feeder main body 31. Incidentally, when the drawer unit 33 is put back to the position set in advance in the feeder main body 31, the detecting switch Sw is turned on.

Also, the containing unit 34 is provided slidably relative to the drawer unit 33, as mentioned above. Thus, for example, when the shaft 332*b* of the driver 332 is rotatably driven in the direction indicated by an arrow of FIG. 3B, the containing unit 34 slides toward the rear side of the feeder main body 31.

The first paper sheet feeder 30 will be further described with reference to FIGS. 4 and 5.

Figure 4:
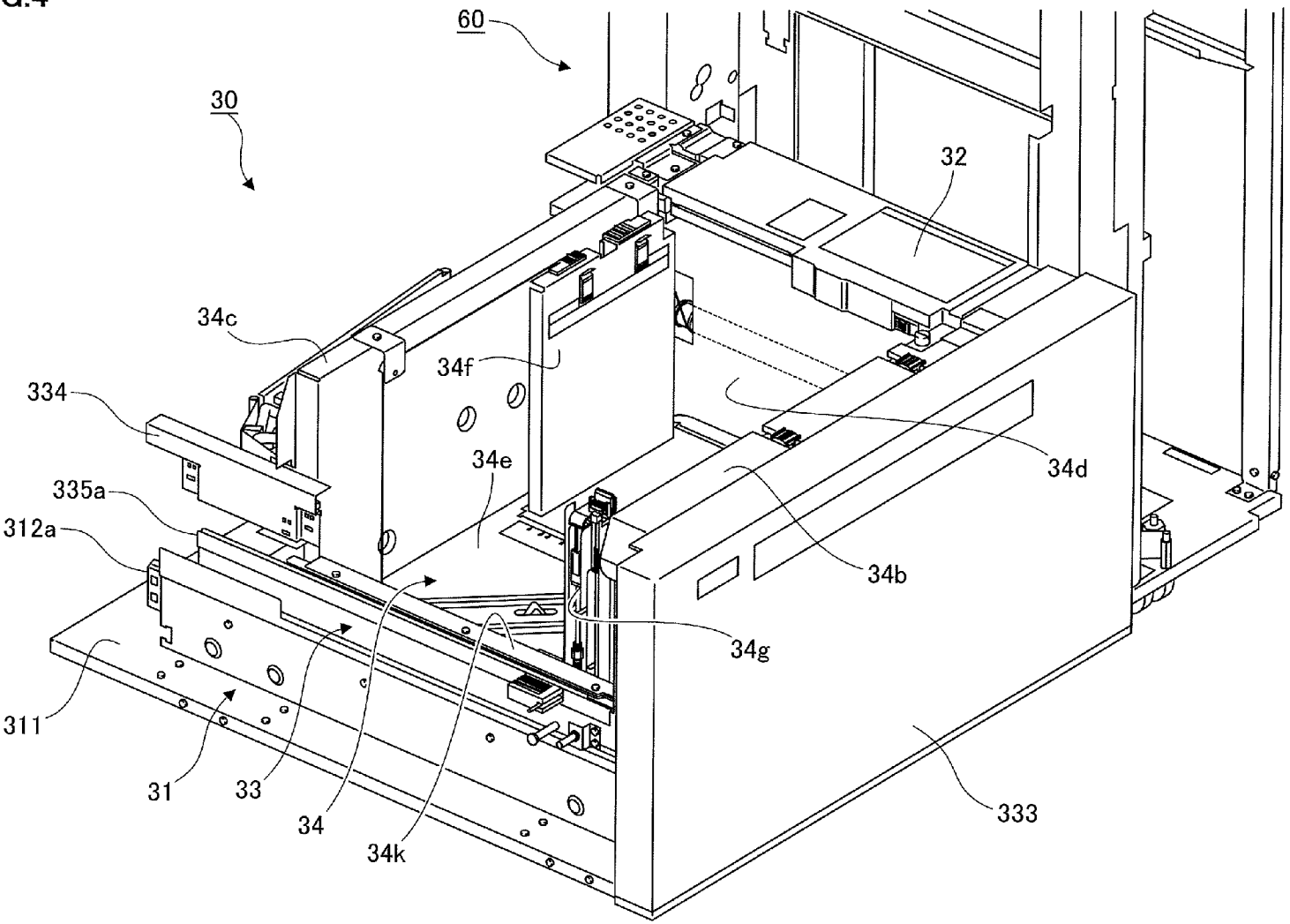
FIG. 4 is a perspective view of the first paper sheet feeder as seen from the front side.

FIG. 4 is a perspective view of the first paper sheet feeder 30 as seen from the front side. Also, FIG. 5 is a perspective view of the first paper sheet feeder 30 as seen from the rear side. Incidentally, in FIGS. 4 and 5, the transferring device 60 is also illustrated.

As shown in FIG. 4, the feeder main body 31 includes an upstream guide rail 312*a* arranged along the direction orthogonal to the paper sheet transport direction, above the base plate 311 and also on the upstream side of the paper sheet transport direction. Also, as shown in FIG. 5, the feeder main body 31 includes a downstream guide rail 312*b* arranged along the direction orthogonal to the paper sheet transport direction, above the base plate 311 and also on the downstream side of the paper sheet transport direction. In other words, the feeder main body 31 includes the two upstream and downstream guide rails 312*a* and 312*b*.

Meanwhile, the drawer unit 33 includes a first guided rail (not shown in the figure) that is guided by the above-mentioned upstream guide rail 312*a*, and that is arranged along the direction orthogonal to the paper sheet transport direction. Also, the drawer unit 33 includes a second guided rail (not shown in the figure) that is guided by the above-mentioned downstream guide rail 312*b*, and that is arranged along the direction orthogonal to the paper sheet transport direction. The drawer unit 33 slides in the direction orthogonal to the paper sheet transport direction as mentioned above, along with the first and second guided rails being guided by the respective upstream and downstream guide rails 312*a* and 312*b*.

Figure 5:
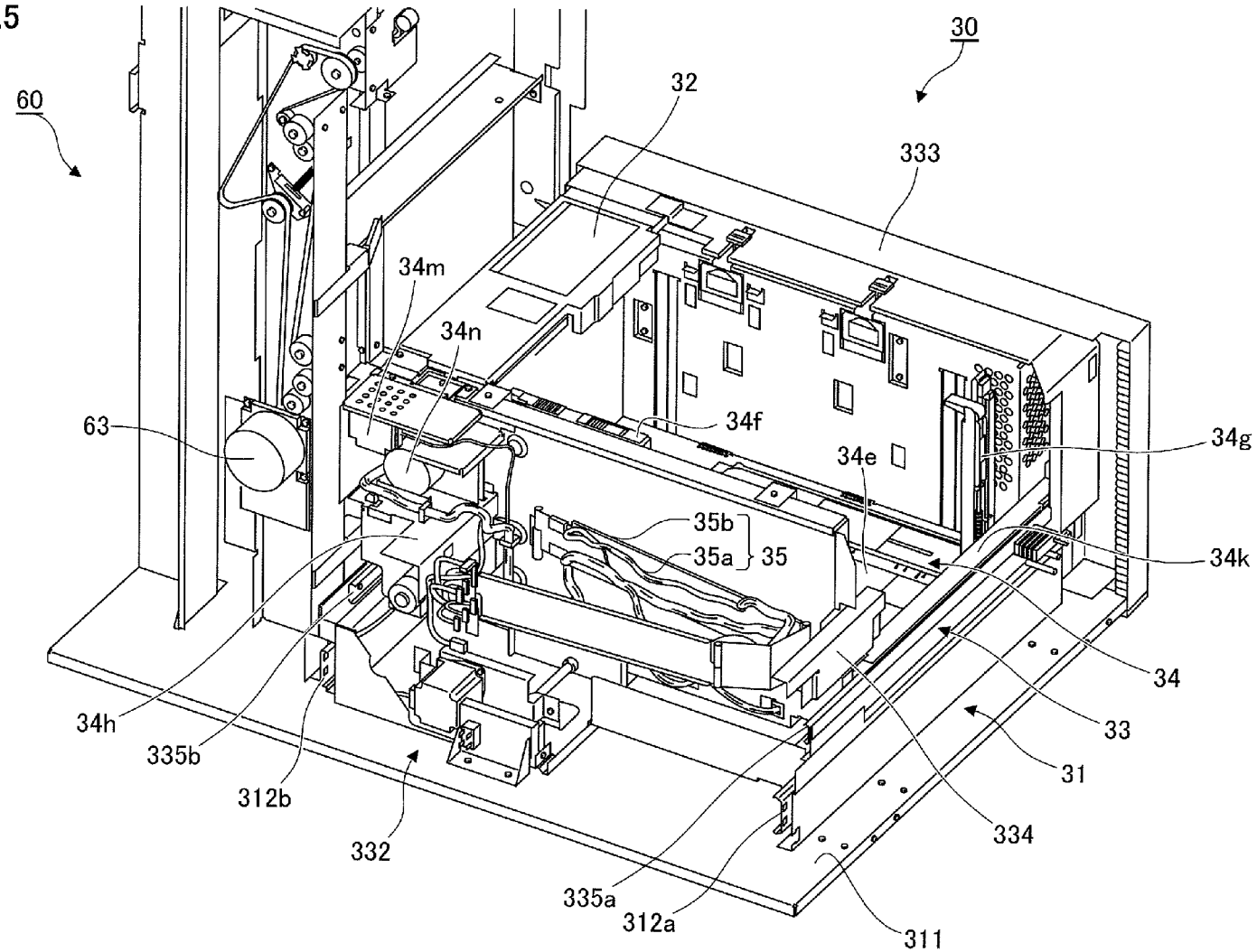
FIG. 5 is a perspective view of the first paper sheet feeder as seen from the rear side.

Also, as shown in FIG. 5, the drawer unit 33 includes an upstream guide rail 335*a* arranged along the direction orthogonal to the paper sheet transport direction and on the upstream side of the paper sheet transport direction. Also, the drawer unit 33 includes a downstream guide rail 335*b* likewise arranged along the direction orthogonal to the paper sheet transport direction and on the downstream side of the paper sheet transport direction.

On the other hand, the containing unit 34 includes a first guided rail 34*k* that is guided by the above-mentioned upstream guide rail 335*a*, and that is arranged along the direction orthogonal to the paper sheet transport direction and on the upstream side of the paper sheet transport direction. Also, the containing unit 34 includes a second guided rail (not shown in the figure) that is guided by the above-mentioned downstream guide rail 335*b*, and that is arranged along the direction orthogonal to the paper sheet transport direction and on the downstream side of the paper sheet transport direction. The containing unit 34 slides in the direction orthogonal to the paper sheet transport direction as mentioned above, along with the first guided rail 34*k* and the second guided rail (not shown in the figure) being guided by the respective upstream and downstream guide rails 335*a* and 335*b*.

Further, as shown in FIG. 5, the containing unit 34 includes a first driving motor 34*n* that rotatably drives the transport roll 324 (see FIG. 1), and a second driving motor 34*m* that rotatably drives the pickup roll 321, the feed roll 322, and the like.

Also, in the present exemplary embodiment, a connection unit 35 that electrically connects the drawer unit 33 and the containing unit 34 is provided. The connection unit 35 is configured of a harness 35*a*, and a supporting plate 35*b* that supports the harness 35*a*. The supporting plate 35*b* is formed into a substantially U-shape by coupling of plural plate members, and is attached at one end thereof to the drawer unit 33 and at the other end thereof to the containing unit 34. Also, each of the plate members of the supporting plate 35*b* is swingable relative to an adjacent different plate member. Thus, when the containing unit 34 slides relative to the drawer unit 33, the supporting plate 35*b* is displaced in accordance with the sliding of the containing unit 34.

Incidentally, the base plate 311 of the first paper sheet feeder 30 supports also the transferring device 60. Here, in the present exemplary embodiment, a motor 63 is mounted also on the rear side of the transferring device 60. A driving force from the motor 63 is transmitted to the transport rolls 61 (see FIG. 1), and thus, the transport rolls 61 are rotatably driven.

Next, the detecting unit 334 will be described.

Figure 6:
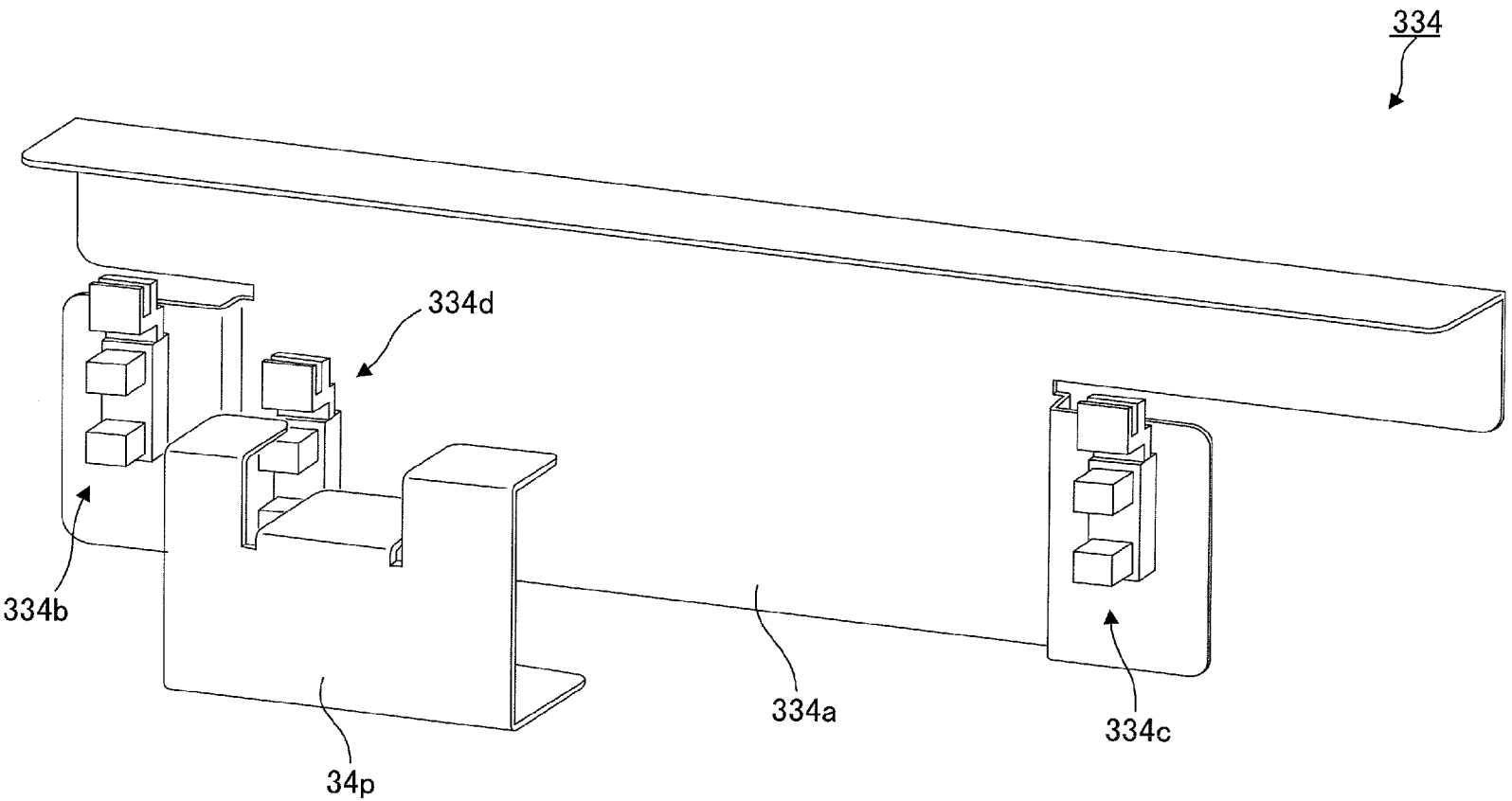
FIG. 6 is a perspective view of the detecting unit as seen from the side where the containing unit is positioned.

FIG. 6 is a perspective view of the detecting unit 334 as seen from the side where the containing unit 34 is positioned. Thus, in FIG. 6, the right side indicates the rear side, and the left side indicates the front side.

As shown in FIG. 6, the detecting unit 334 includes a supporting plate 334*a* arranged along the direction orthogonal to the paper sheet transport direction, a first sensor 334*b*, a second sensor 334*c*, and a third sensor 334*d*. Incidentally, the first sensor 334*b* is arranged on the front side, and the second sensor 334*c* is arranged on the rear side. Also, the third sensor 334*d* is arranged between the first sensor 334*b* and the second sensor 334*c* and also on the front side.

Each of the first to third sensors 334*b* to 334*d* is turned on when a detecting plate 34*p* attached to the containing unit 34 reaches a detecting region. In contrast, each sensor is turned off when the detecting plate 34*p* goes out of the detecting region. Note that, the first sensor 334*b* that acts as a detector detects an unintended movement of the containing unit 34 caused by operation error or the like. Also, the second sensor 334*c* that acts as a detector, likewise, detects the unintended movement of the containing unit 34 caused by the operation error or the like. In other words, the first sensor 334*b* and the second sensor 334*c* detect that the containing unit 34 has moved beyond a moving range set in advance. Then, if the first sensor 334*b* or the second sensor 334*c* detects the containing unit 34, that is, if the sensor is turned on, the controller 70 stops the motor 332*a* of the driver 332.

Here, the image forming apparatus main body 10 or the transferring device 60 uses a center position (see the reference character CL in FIG. 2) of the paper sheet in the direction orthogonal to the transport direction, as a reference for paper sheet transport, although the description has been omitted above. On the other hand, in the first paper sheet feeder 30, the paper sheet is contained by being hit against the first side plate 34*b* that functions as a hitting unit at the side edge of the paper sheet in its width direction, and also, in this state, the paper sheet is supplied. In other words, in the first paper sheet feeder 30, the paper sheet is contained with reference to the first side plate 34*b*, and also, the paper sheet is supplied with reference to the side edge of the paper sheet. That is, the image forming apparatus main body 10 or the transferring device 60 employs the center-based approach of using the center position of the paper sheet as the reference for the paper sheet transport, while the first paper sheet feeder 30 employs the side-based approach of using one side edge of the paper sheet as the reference for the paper sheet transport. In the present exemplary embodiment, therefore, the containing unit 34 is caused to slide relative to the drawer unit 33 as mentioned above, for the supply of the paper sheet from the first paper sheet feeder 30 to the transferring device 60 or the like, using the center as the reference.

Incidentally, a configuration in which the center position is used as the reference for the paper sheet transport allows a uniform arrangement of the transport rolls or the like in the width direction of the paper sheet, regardless of the size of a paper sheet, thus stabilizing the paper sheet transport.

Also, in the case of employing the side-based approach for the paper sheet feeder, as described in the present exemplary embodiment, operation for setting the paper sheet may be improved, as compared to the center-based approach. Here, for example, if the center-based approach is employed for the paper sheet feeder, a pair of side guides are typically provided, and the paper sheet is placed between the pair of side guides. Then, the side guides are moved in a direction in which a distance therebetween becomes narrower, thereby to align the paper sheet.

Meanwhile, in this case, during the movement of the side guides, one of the side guides may possibly come into contact with the paper sheet earlier than the other side guide. Then, in this case, the one side guide is necessary to be moved together with the paper sheet, and thus, if a large number of paper sheets is contained, this increases operation load required for movement of the side guide. On the other hand, with the side-based approach as in the case of the present exemplary embodiment, generally, the paper sheet to be contained are hit in advance against an immovable portion such as the first side plate 34*b*, which reduces the likelihood of occurrence of a situation where the side guide is moved together with the paper sheet. As a result, the operation load for the movement of the side guide is reduced. Thus, the side-based approach allows the operation for setting the paper sheet to be improved, as compared to the center-based approach.

Next, the operation of the first paper sheet feeder 30 will be described more specifically.

Figure 7:
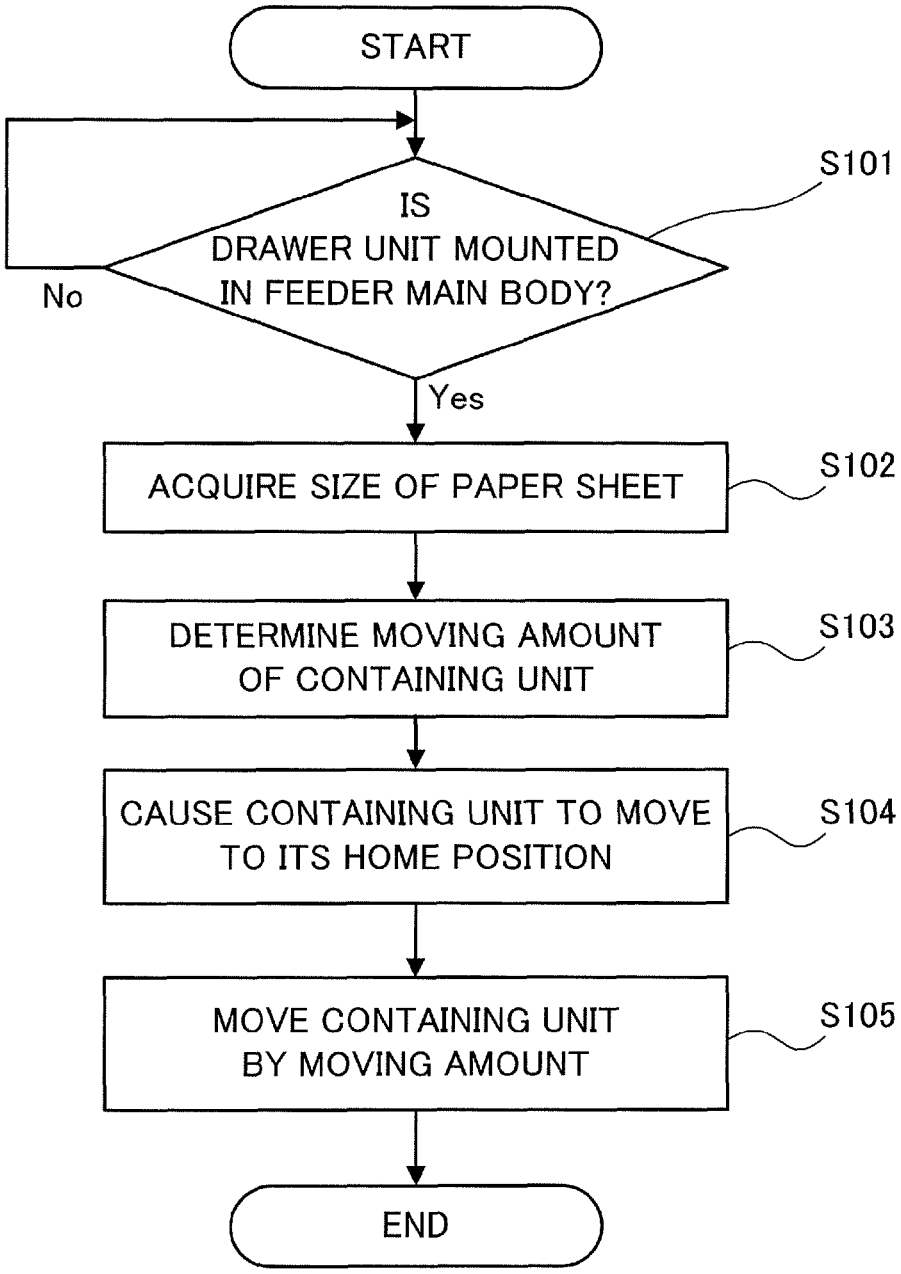
FIG. 7 is a flowchart showing processing which is executed by the controller when the drawer unit is mounted in the feeder main body.

FIG. 7 is a flowchart showing processing which is executed by the controller 70 when the drawer unit 33 is mounted in the feeder main body 31.

First, the controller 70 determines whether or not the drawer unit 33 is mounted in the feeder main body 31, on the basis of a signal from the detecting switch Sw (step 101). Incidentally, if determining that the drawer unit 33 is not mounted, the controller 70 executes the processing of step 101 again. Then, if determining that the drawer unit 33 is mounted in the feeder main body 31, the controller 70 acquires the size of the paper sheet contained in the containing unit 34 (i.e., the size of the paper sheet in its width direction), on the basis of signals from the detecting sensors S1 to S3 (step 102). More specifically, the controller 70 acquires the size of the paper sheet in the direction orthogonal to the paper sheet transport direction.

Then, the controller 70 determines the moving amount (or sliding amount) of the containing unit 34, on the basis of the acquired size of the paper sheet (step 103). Specifically, the controller 70 determines driving time T for the motor 332*a* of the driver 332, on the basis of the acquired size of the paper sheet. Here, the driving time T may be determined for example by storing a table indicating the relationship between the paper sheet size and the driving time T in a memory (not shown in the figure), and by referring to the table. Incidentally, the driving time T is typically set to be short if the size of the paper sheet is large. In contrast, the driving time T is typically set to be long if the size of the paper sheet is small. Then, the controller 70 causes the containing unit 34 to move to its home position (step 104). Specifically, the controller 70 drives the motor 332*a* to move the containing unit 34 until the third sensor 334*d* is turned on.

After that, the controller 70 redrives the motor 332*a* to move the containing unit 34 by the moving amount determined in step 103 (step 105), and then the processing is terminated. For example, the controller 70 drives the motor 332*a* in the reverse direction to move the containing unit 34 to the rear side. Then, the controller 70 stops the motor 332*a* after the elapse of the driving time T, with reference to the time at which the third sensor 334*d* is turned off. As a result, the center position (or central position) of the paper sheet contained in the containing unit 34 in the direction orthogonal to the paper sheet transport direction coincides with the center position (or central position) of the transferring device 60 or the image forming apparatus main body 10.

In the present exemplary embodiment, in order to coincide the center position of the paper sheet contained in the containing unit 34 with the center position of the transferring device 60 or the image forming apparatus main body 10, the containing unit 34 located within the first paper sheet feeder 30 moves as mentioned above. In the present exemplary embodiment, at this time, the drawer unit 33 that is visible from the outside does not move.

Here, for example, the drawer unit 33 itself may be moved to coincide the center position of the paper sheet with the center position of the transferring device 60 or the image forming apparatus main body 10. In such an example, however, if there are plural paper sheet feeders, an edge face of the drawer unit of one paper sheet feeder may not be aligned with an edge face of the drawer unit of the other paper sheet feeder, and hence the one drawer unit may project relative to the other drawer unit, in some cases. Also, the presence of a greater number of paper sheet feeders, such as four or six, may possibly lead to misalignment of the edge faces of the drawer units and hence to unevenness in the edge faces. On the other hand, the present exemplary embodiment is configured in such a manner that the drawer unit 33 externally recognizable does not move, while the containing unit 34 located inside and thus externally unrecognizable moves. This configuration may suppress the occurrence of the above-mentioned misalignment of the edge faces or the like.

Incidentally, in the above-mentioned exemplary embodiment, a description has been given with regard to the configuration in which the containing unit 34 of the first paper sheet feeder 30 provided aside from the image forming apparatus main body 10 slides. However, the present invention is not limited to this, and the same configuration as described above may be employed, for example, for a paper sheet feed cassette provided in the image forming apparatus main body 10 so that the cassette is capable of being pulled out.

Also, if the size of the paper sheet may be specified from an operation panel of the image forming apparatus or externally-provided terminal device, the moving amount of the containing unit 34 may be determined, on the basis of the specified size.

Further, for example, when the drawer unit 33 is pulled out, the containing unit 34 may be moved toward the front side, that is, in the direction in which the drawer unit 33 is pulled out. Specifically, when the detecting switch Sw is turned off, the motor 332*a* may be driven to move the containing unit 34 toward the front side. Also, an operation receiving unit such as an operation panel that receives operation from the user, for example, may be provided so that, when the operation receiving unit receives a predetermined operation, the containing unit 34 may be moved toward the front side. Incidentally, in this case, a restricting mechanism that restricts the pulling out of the drawer unit 33 may be further provided so that restriction by the restricting mechanism may be released after the completion of the movement of the containing unit 34 toward the front side.

The movement of the containing unit 34 toward the front side as mentioned above leads to the shift of the position of paper sheet containment toward the front side, and thus the operation for the paper sheet containment in the containing unit 34 may be improved, as compared to a case where the containing unit 34 is not moved.

Also, an air blowing device that blows air to the paper sheets stacked on the bottom plate 34*e* thereby to separate the paper sheets may be provided.

Figure 8:
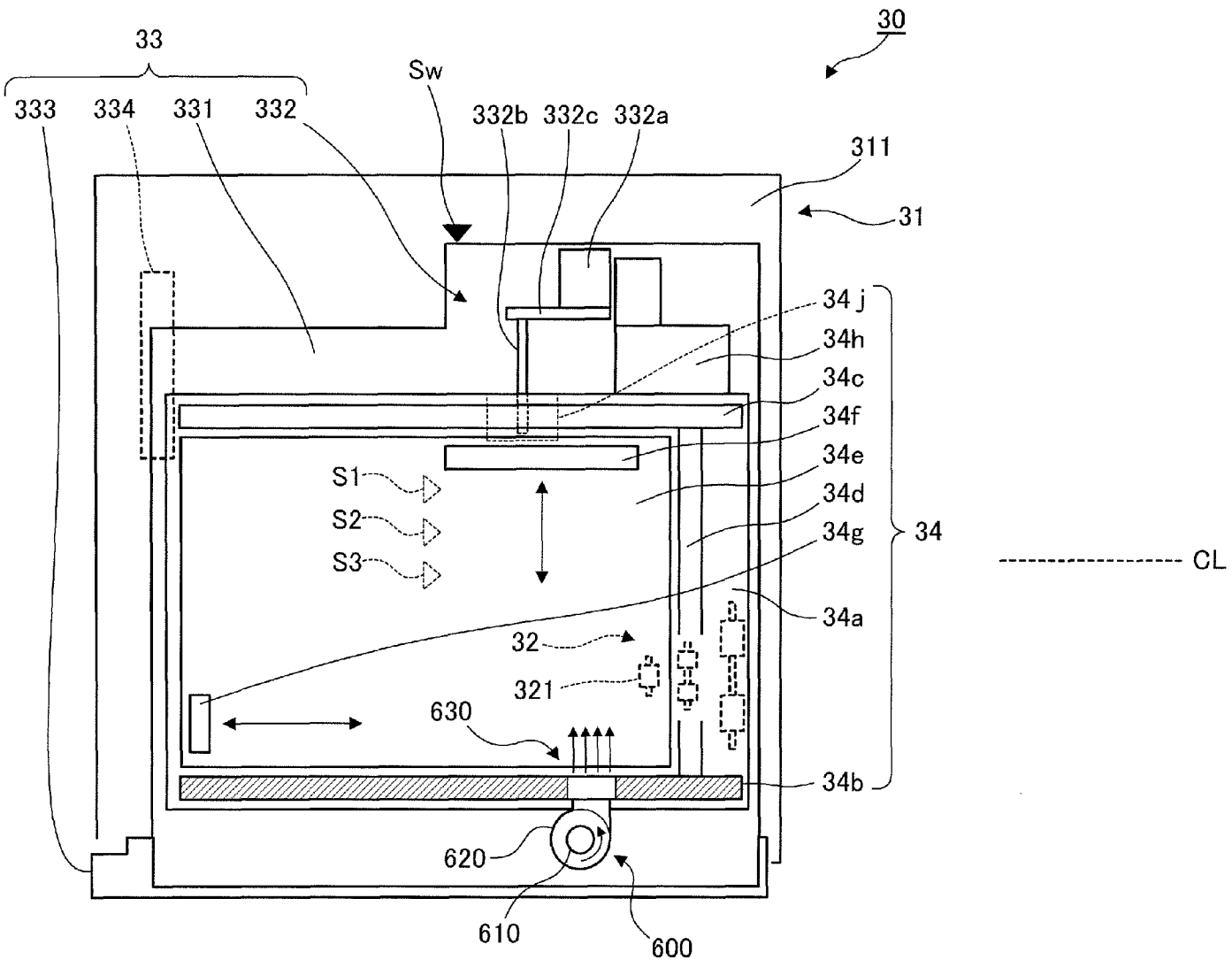
FIGS. 8 and 9 are views showing another configuration example of the first paper sheet feeder.
Figure 9:
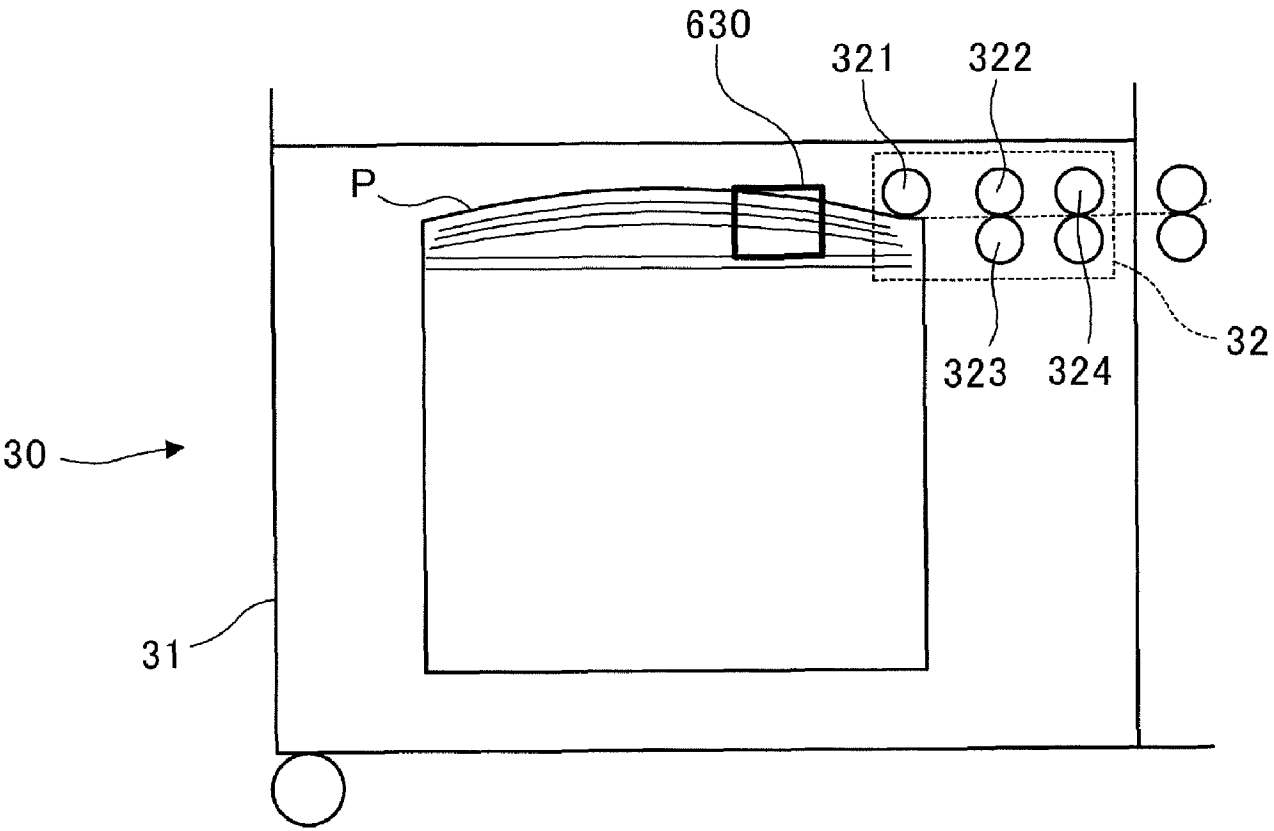

FIGS. 8 and 9 are views showing another configuration example of the first paper sheet feeder 30.

As shown in FIG. 8, an air blowing device 600 that blows air to the stacked paper sheets may be provided to the first paper sheet feeder 30. The air blowing device 600 includes a fan 610 provided rotatably in an arrow direction of FIG. 8, a duct 620 that forms an air flow path, and a driving source (not shown in the figure) such as a motor that drives the fan 610. Here, the air blowing device 600 is attached to the containing unit 34, and thus, the sliding of the containing unit 34 leads to the movement of the air blowing device 600 together with the containing unit 34.

The air ejected from the air blowing device 600 blows the paper sheets through an opening 630 formed in the first side plate 34*b*. Here, as shown in FIG. 9, the opening 630 is provided at substantially the same level as the paper sheet feeding portion 32, and thus, the air ejected from the air blowing device 600 blows the upper part of the stacked paper sheet. This results in the entry of air between the paper sheets located at the upper part of a paper sheet bundle, thus leading to the floating of the paper sheets located at the upper part. Here, a coated paper sheet given coating in order to increase glossiness, for example, may be contained in the containing unit 34. Such a paper sheet is prone to be transported in a state where plural paper sheets are overlapped with each other, that is, in a state of simultaneous transport of plural paper sheets, due to high attraction between the paper sheets. The provision of the air blowing device 600 as mentioned above reduces the attraction between the paper sheets, thus suppressing the occurrence of the simultaneous transport of the plural paper sheets.

Incidentally, in the present exemplary embodiment, as mentioned above, the first side plate 34*b* fixed to the base plate 34*a*, and the slidable side guide 34*f* are provided for purposes of alignment of the paper sheet in the direction orthogonal to the paper sheet transport direction. In other words, the first paper sheet feeder 30 employs the side-based approach. In addition, in the present exemplary embodiment, the air blowing device 600 is attached to the fixed first side plate 34*b*. Meanwhile, if the first side plate 34*b* is slidable, the center-based approach may be employed. In this case, however, the provision of the air blowing device 600 leads to the complicated configuration. In other words, the air blowing device 600 is mounted on a movable (or slidable) part, which leads to the complicated configuration. The paper sheet feeder that employs the side-based approach as in the case of the present exemplary embodiment facilitates the mounting of the air blowing device 600, as compared to the paper sheet feeder that employs the center-based approach.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet containing apparatus, comprising:

an apparatus main body;

a drawer that is capable of being pulled out from the apparatus main body;

a sheet container that is movable relative to the drawer and that contains a sheet;

a feeder that feeds a sheet contained in the sheet container; and a moving unit that moves the sheet container in a direction intersecting with a feed direction in which the feeder feeds a sheet, wherein the sheet container includes:

a main body;

a stacking unit on which a sheet is to be stacked; and a hitting unit that is fixedly arranged in the main body so as to extend in the feed direction and the hitting unit against which a side edge of a sheet thus stacked is hit, and the sheet container contains a sheet with reference to the hitting unit.

2. The sheet containing apparatus according to claim 1, wherein the moving unit moves the sheet container by using a driving source provided in the drawer.

3. The sheet containing apparatus according to claim 1, further comprising a detector detecting that the sheet container moved by the moving unit is moved beyond a moving range set in advance.

4. The sheet containing apparatus according to claim 1, wherein the moving unit moves the sheet container in a direction in which the drawer is pulled out, when the drawer is pulled out.

5. The sheet containing apparatus according to claim 1, wherein the sheet container is pulled out from the apparatus main body together with the drawer, when the drawer is pulled out from the apparatus main body.

6. The sheet containing apparatus according to claim 1, wherein the sheet container is independently movable relative to the drawer in the direction intersecting with the feed direction in which the feeder feeds a sheet.

7. An image forming system, comprising:

an image forming apparatus including a transporting unit that transports a sheet, by setting, as a reference position, a center position of the sheet in a direction orthogonal to a transport direction when transporting the sheet, and an image forming part that forms an image on the sheet transported by the transporting unit; and a plurality of sheet containing apparatuses that each contain a sheet to be supplied to the image forming apparatus, the plurality of sheet containing apparatuses, each including:

an apparatus main body;

a drawer that is capable of being pulled out from the apparatus main body;

a sheet container that is movable relative to the drawer and that contains a sheet;

a feeder that feeds a sheet contained in the sheet container; and a moving unit that moves the sheet container in a direction intersecting with a feed direction in which the feeder feeds a sheet, wherein each of the plurality of sheet containing apparatuses further includes an air blowing unit that is attached to the sheet container and that blows air into a gap between sheets contained in the sheet container.

8. The image forming system according to claim 7, wherein the moving unit moves the sheet container so that the center position of a sheet contained in the sheet container in a direction orthogonal to the feed direction coincides with the reference position.

9. An image forming system, comprising:

an image forming apparatus including a transporting unit that transports a sheet, by setting, as a reference position, a center position of the sheet in a direction orthogonal to a transport direction when transporting the sheet, and an image forming part that forms an image on the sheet transported by the transporting unit; and a sheet containing apparatus that contains a sheet to be supplied to the image forming apparatus, the sheet containing apparatus including:

an apparatus main body;

a drawer that is capable of being pulled out from the apparatus main body;

a sheet container that is movable relative to the drawer and that contains a sheet; and a moving unit that moves the sheet container, the sheet container including a feeder that feeds a sheet contained in the sheet container, a stacking unit on which a sheet is to be stacked, and a hitting unit that is fixedly provided in the sheet container so as to extend in a feed direction in which the feeder feeds a sheet, and the hitting unit against which a side edge of a sheet to be stacked is hit for positioning of a sheet at the reference position, the moving unit moving the sheet container in a direction intersecting with the feed direction, and also moving the sheet container so that the center position of a sheet contained in the sheet container in a direction orthogonal to the feed direction coincides with the reference position, wherein the sheet container further includes: a side plate that acts as the hitting unit; and an air blowing unit that is attached to the sheet container and that blows air into a gap between sheets contained in the sheet container, and the air blowing unit is provided on the side plate.

10. A sheet containing apparatus, comprising:

an apparatus main body;

a drawer that is capable of being pulled out from the apparatus main body;

a sheet container that is movable relative to the drawer and that contains a sheet;

a feeder that feeds a sheet contained in the sheet container; and a moving unit that moves the sheet container in a direction intersecting with a feed direction in which the feeder feeds a sheet;

wherein, when the drawer is pulled out from the apparatus main body in the direction intersecting with the feed direction, the sheet container is relatively moved inside the drawer in the same direction of the drawer by the moving unit along with a pulling out of the drawer.

* * * * *